US007249555B2

(12) United States Patent
Yoo

(10) Patent No.: US 7,249,555 B2
(45) Date of Patent: Jul. 31, 2007

(54) ACTUATOR HAVING THE FUNCTION OF CONTROL OF OPERATION DISPLACEMENT

(76) Inventor: Keun Hyung Yoo, Hyundai I Park 108-105, Shinhyung-Dong, 3GA, Jung-Gu, Incheon (KR)

( * ) Notice: Subject to any disclaimer, the term of this patent is extended or adjusted under 35 U.S.C. 154(b) by 0 days.

(21) Appl. No.: 10/549,420

(22) PCT Filed: Apr. 3, 2004

(86) PCT No.: PCT/KR2004/000780

§ 371 (c)(1),
(2), (4) Date: Sep. 15, 2005

(87) PCT Pub. No.: WO2004/088147

PCT Pub. Date: Oct. 14, 2004

(65) Prior Publication Data

US 2006/0169130 A1 Aug. 3, 2006

(30) Foreign Application Priority Data

Apr. 3, 2003 (KR) ..... 10-2003-0021011

(51) Int. Cl.
*F01B 31/12* (2006.01)

(52) U.S. Cl. ..... 92/5 R

(58) Field of Classification Search ..... 91/392, 91/393; 92/5 R, 5 L
See application file for complete search history.

(56) References Cited

U.S. PATENT DOCUMENTS

| | | | | |
|---|---|---|---|---|
| 2,655,903 | A * | 10/1953 | Tyler | 91/1 |
| 4,896,584 | A * | 1/1990 | Stoll et al. | 92/5 R |
| 2002/0017190 | A1 | 2/2002 | Sakurai | |

FOREIGN PATENT DOCUMENTS

| | | |
|---|---|---|
| DE | 3329171 | 2/1985 |
| JP | 03-168402 | 7/1991 |
| JP | 04-34203 | 2/1992 |

* cited by examiner

*Primary Examiner*—F. Daniel Lopez
(74) *Attorney, Agent, or Firm*—IPLA P.A.; James E. Bame

(57) ABSTRACT

This invention is an actuator having the function of control operation displacement. The invention comprises of cylinder (100), pistons (160), a rotating axis (140) rotatably mounted through the wall of the cylinder (100), a power transmission unit (120, 130) connected between the piston (160) and the rotating axis (140), the flow pathways (11, 12) connecting the first and the second space (101, 102) to the exterior solenoid valve (20), a magnet (231) provided on one side of the piston (160), a guide (211) provided on one side of the cylinder (100), a slider (213) being guided by the guide (211) and moving reciprocally along the piston (160), a magnet sensor (235) adjacent to the wall of the cylinder.

2 Claims, 6 Drawing Sheets

A

B

C

ACTUATOR HAVING THE FUNCTION OF CONTROL OF OPERATION DISPLACEMENT

FIELD OF THE INVENTION

This invention relates to an actuator having the function of control of operation displacement, and more particularly to an actuator in which the angle range of the rotating axis could be easily adjusted by means of simple magnetic sensor without complicated control device.

BACKGROUND OF THE INVENTION

Generally, the actuator is a device which is coupled to a desired unit and provides a driving unit with a forward or backward force and/or a rotating force generated by the hydraulic or pneumatic source. The actuator according to the present invention may be applied to both hydraulic and pneumatic actuators, but for convenience, all description and explanation will be given for the pneumatic actuator, hereinafter.

FIG. 1 depicts an example of actuator according to the prior art, in which a pneumatic actuator for operating a swivel valve is shown. As seen from the drawing, the actuator comprises a pair of piston 160 positioned at both side of interior of cylinder 100; a rotating axis 140 rotating in either direction by the forward or backward action of piston 160; the first air pathway 103 connecting the space 101 between the pistons 160 to the exterior of cylinder; and the second air pathway 104 connecting the space 102 between the pistons 160 and the corresponding cylinder end wall to the exterior of cylinder, thereby opening and shutting the valve connected to the rotating axis 140 by each forward or backward action of the opposed pistons 160 by means of the direction of the compressed air provided through the first and second air pathways 103, 104.

In this actuator, if any external device is coupled with the rotating axis 140, an additional control unit is necessarily required to adjust an action range of the external device such as the angle of valve opening. This control unit comprises of a sensor to detect the displacement of the rotating axis 40, and a controller to control the action of the solenoid valve 20 according to the input data from the sensor and input means to set the action range of the device. And the cost of all these components is expensive, which results in high cost in installing the actuator.

SUMMARY OF THE INVENTION

The invention is provided to solve the problems as described above and the object of the invention is to suggest a novel actuator having the function of control of operation displacement in which the angle range of the rotating axis could be easily adjusted by means of simple magnetic sensor without additional complicated control device so as to achieve a cost down.

According to one aspect of the invention, there is provided an actuator having the function of control of operation displacement, which comprises of cylinder 100 in which a working flow is supplied, one or more piston 160 reciprocally movable in the cylinder 100 to divide the inner space of cylinder 100 into the first space 101 and the second space 102, a rotating axis 140 rotatably mounted through the wall of the cylinder 100, a power transmission unit 120, 130 connected between the piston 160 and the rotating axis 140 to transfer the reciprocating force of piston 160 to the rotating axis 140 and the flow pathways 11, 12 connecting the first and the second space 101, 102 to the exterior solenoid valve 20, and the rotating axis 140 could be rotated according to the action of solenoid valve 20, characterized in that the actuator further comprises of a magnet 231 provided on one side of the piston 160, a guide 211 provided on one side of the cylinder 100 in the reciprocal direction of the piston 160, a slider 213 being guided by the guide 211 and moving reciprocally along the piston 160, a working rod 233 extending from one side of the slider 213 toward the center of the cylinder 100, a magnetic sensor 235 provided on the working rod 233 and being adjacent to the wall of the cylinder 100, the magnetic sensor 235 being capable of sending a signal to the solenoid valve 20 if the magnet 231 is sensed, and a action range setting means 219, 221 having the scale representing displacement of the magnetic sensor 235.

According to another aspect of the invention, there is provided an actuator having the function of control of operation displacement, wherein a slide hole 211*a* is formed in the longitudinal direction on the center of the guide 211, and a reciprocating rod 217 is inserted on the slide hole 211*a* to move the piston 160 reciprocally.

According to another aspect of the invention, there is provided an actuator having the function of control of operation displacement, which comprises of cylinder 100 in which a working flow is supplied, one or more piston 160 reciprocally movable in the cylinder 100 to divide the inner space of cylinder 100 into the first space 101 and the second space 102, a rotating axis 140 rotatably mounted through the wall of the cylinder 100, a power transmission unit 120, 130 connected between the piston 160 and the rotating axis 140 to transfer the reciprocating force of piston 160 to the rotating axis 140 and the flow pathways 11, 12 connecting the first and the second space 101, 102 to the exterior solenoid valve 20, and the rotating axis 140 could be rotated according to the action of solenoid valve 20, characterized in that the actuator further comprises of a magnet 231 provided on one side of the piston 160, a guide 211 provided on one side of the cylinder 100 vertically to reciprocal direction of the piston 160, a slider 213 being guided by the guide 211 and moving vertically to the reciprocal direction of the piston 160, a sliding plate 241 provided outside of the cylinder 100 and being movable along the reciprocating piston 160 and having an inclined slot 243 by which the guide 211 is engaged, a magnetic sensor 235 provided on one side of the sliding plate 241 and being adjacent to the wall of the cylinder 100, the magnetic sensor 235 being capable of sending a signal to the solenoid valve 20 if the magnet 231 is sensed, and a action range setting means 219, 221 having the scale representing displacement of the magnetic sensor 235, and sliding plate 241 is slid along the reciprocal direction of the piston 160 as the slider 213 moves vertically.

According to another aspect of the invention, there is provided an actuator having the function of control of operation displacement, wherein a slide hole 211*a* is formed in the longitudinal direction on the center of the guide 211, and a reciprocating rod 217 is inserted on the slide hole 211*a* to move the piston 160 reciprocally.

BEST MODE FOR CARRING OUT THE INVENTION

Preferred embodiments of the invention will be described in detail below by referring to the accompanying drawings.

Figure 1:
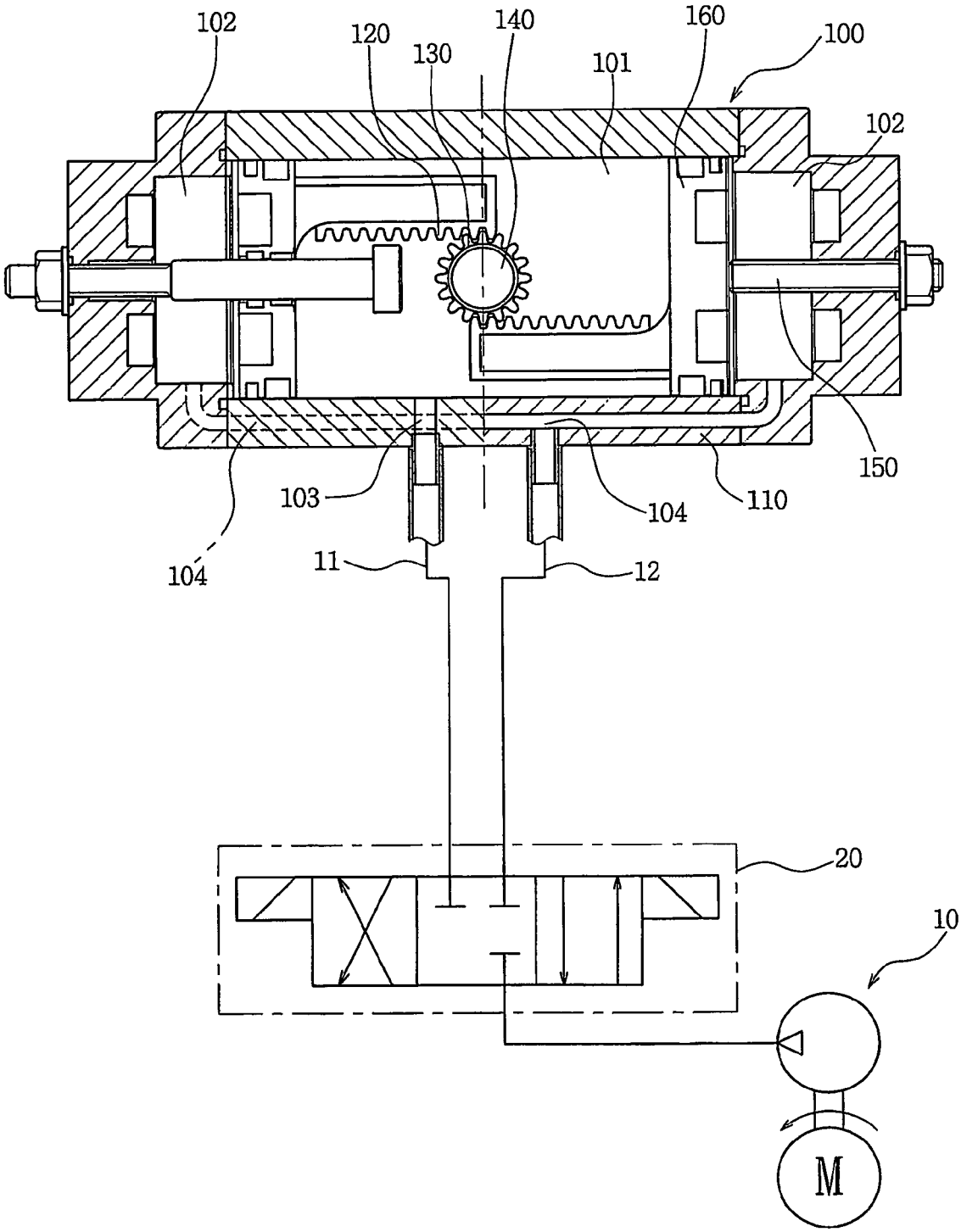
FIG. 1 is a section of the conventional actuator
Figure 2:
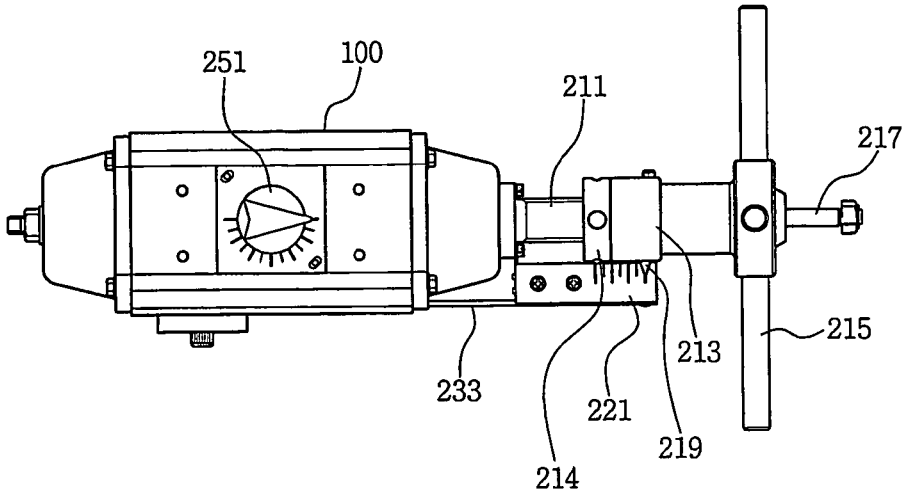
FIG. 2A to 2C are front view, plan view and side view of the embodiment of the invention respectively
Figure 2:
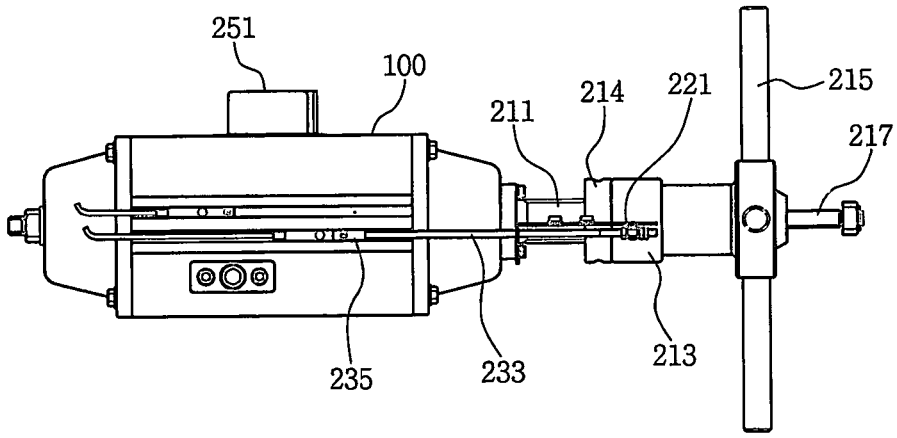
Figure 2:
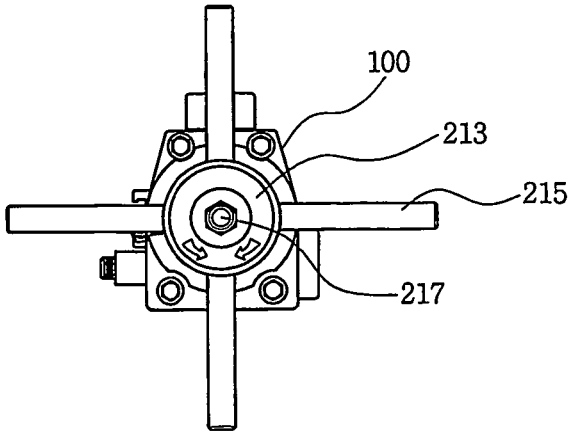
Figure 3:
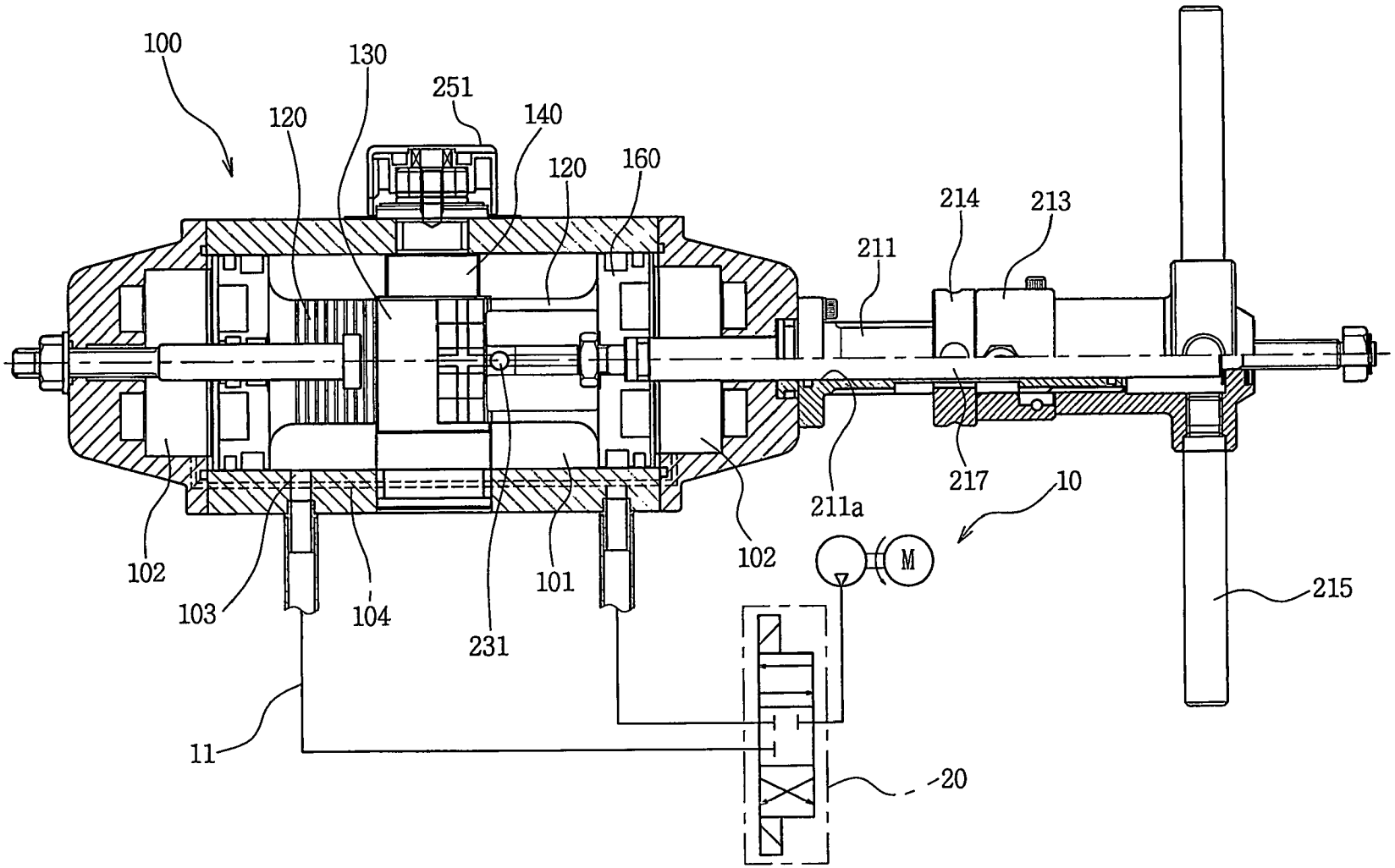
FIG. 3 is a section of FIG. 2A

FIGS. 2A to 2C are front view, plan view and side view respectively of the embodiment of the invention and FIG. 3 is a section of FIG. 2A.

As shown in the drawings, the actuator comprises of cylinder 100 in which working flow is supplied, a pair of piston 160 reciprocally movable in the cylinder 100, a power transmission unit having racks 120 mounting on the piston 160 and reciprocate to each other and a pinion 130 being engaged with the racks 120 and mounted rotatably in the cylinder 100. A rotating axis 140 is mounted on the wall of cylinder 100 to be the center of the pinion 130.

And a magnet 231 is mounted on the side of the piston 160. An axial guide 211 is provided on the longitudinal end of the cylinder 100 along the reciprocal direction of the piston 160. And a slider 213 is threaded on the guide 211 and rotated to slide along the reciprocal direction of the piston. A working rod 233 is attached on one side of the slider 213 and extending toward the center of the cylinder 100. And a magnetic sensor 235 is provided on the working rod 233 and is adjacent to the wall of cylinder 100. And an action range setting means 219, 221 is provided on the working rod 233 to represent the displacement of the magnetic sensor 235. And the cylinder 100 is provided with the flow pathways 11, 12 connecting the air compressor 10 and a solenoid valve 20 is connected on these flow pathway 11, 12.

The inner space of the cylinder 100 is partitioned by pistons 160 into the first space 101 between the pistons 160 and the second space 102 outside the piston 160. And on the wall of the cylinder 100 is formed the first flow pathway 103 connecting the first space 101 to the flow pathway 11 and the second flow pathway 104 connecting the second space 102 to the flow pathway 12. And the two flow pathways 11, 12 are connected to the solenoid valve 20. Accordingly, the compressed air from the air compressor 10 could be selectively supplied to the first space 101 or the second space 102 by manipulating the solenoid valve 20.

The slider 213 is rotated to move the magnetic sensor 235 to a predetermined position and has a handle 215 on its end. On one side of the slider 213 is provided a clamp nut 214 so that the slider 213 is clamped on the guide 211 at a predetermined position. A slide hole 211*a* is formed in the longitudinal direction on the center of the guide 211 and a reciprocating rod 217 is inserted on the slide hole 211*a* to reciprocate the piston 160 manually.

The magnetic sensor 235 is to detect that the piston 160 has arrived to a set position and it is moved by the slider 213 to a predetermined position. If the piston 160 comes near and the magnet 231 is detected by the magnetic sensor 235, it will send a signal to a solenoid valve 20 and the solenoid valve will shut or open the flow pathway in a predetermined way.

The action range setting means 219, 221 sets the action range of the rotating axis 140 and is comprised of scale 221 installed on the cylinder 100 adjacent to slider 213 to represent the rotated angle of the rotating axis 221 and the needle 219 attached on the slider 213. And, an indicator 251 is provided on the cylinder 100 to show the actual rotated angle of the rotating axis 140.

The function of the invention will be described below. The user may turn the handle 215 to locate the magnetic sensor 235 connected on the slider 213 to a predetermined position. At this time, the user may watch the needle 219 pointing the scale 221 and moving the slider 213. And if it arrives at a set position, the clamp nut 214 should be clamped to stop the slider 213.

And power will be applied to solenoid valve 20, and the compressed air will selectively supplied to the first space 101 or the second space 102 of the cylinder 100 according to the set of the solenoid 20. Accordingly, the piston 160 will move the racks 120 reciprocally and the pinion 130 will be rotated to drive the external device through the rotating axis 140.

If the magnet 231 is detected by the magnetic sensor 235 while the pistons reciprocate, the solenoid valve 20 will shut the air to the cylinder 100, and the rotating axis 140 may be stop. And if the external device coupled to rotating axis 140 is a valve, the rotated angle of the valve can be adjusted. As a result, the invention could achieve an actuator with adjustable action range with a simple structure and low cost.

Figure 4:
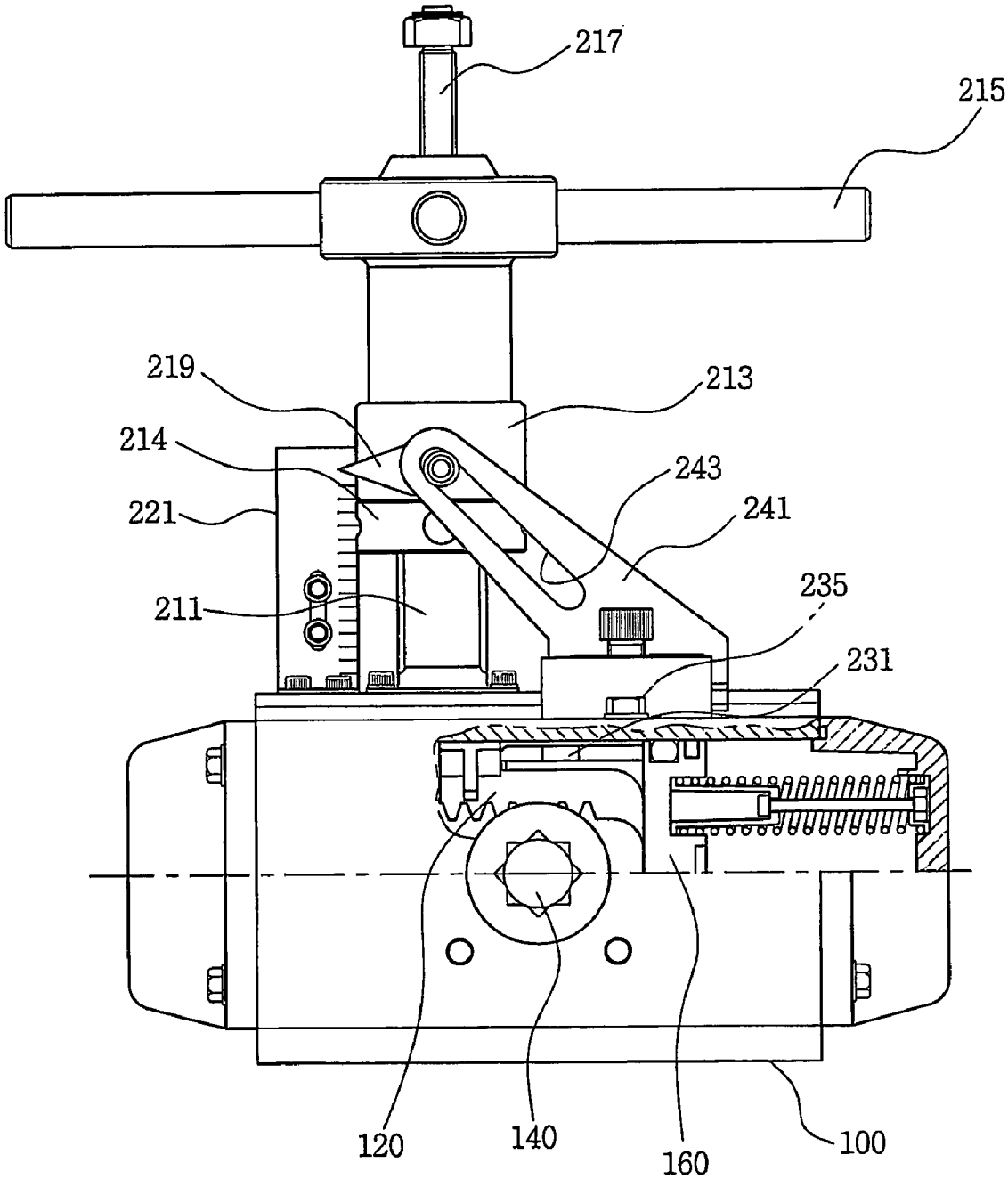
FIG. 4 is another embodiment of the invention
Figure 5:
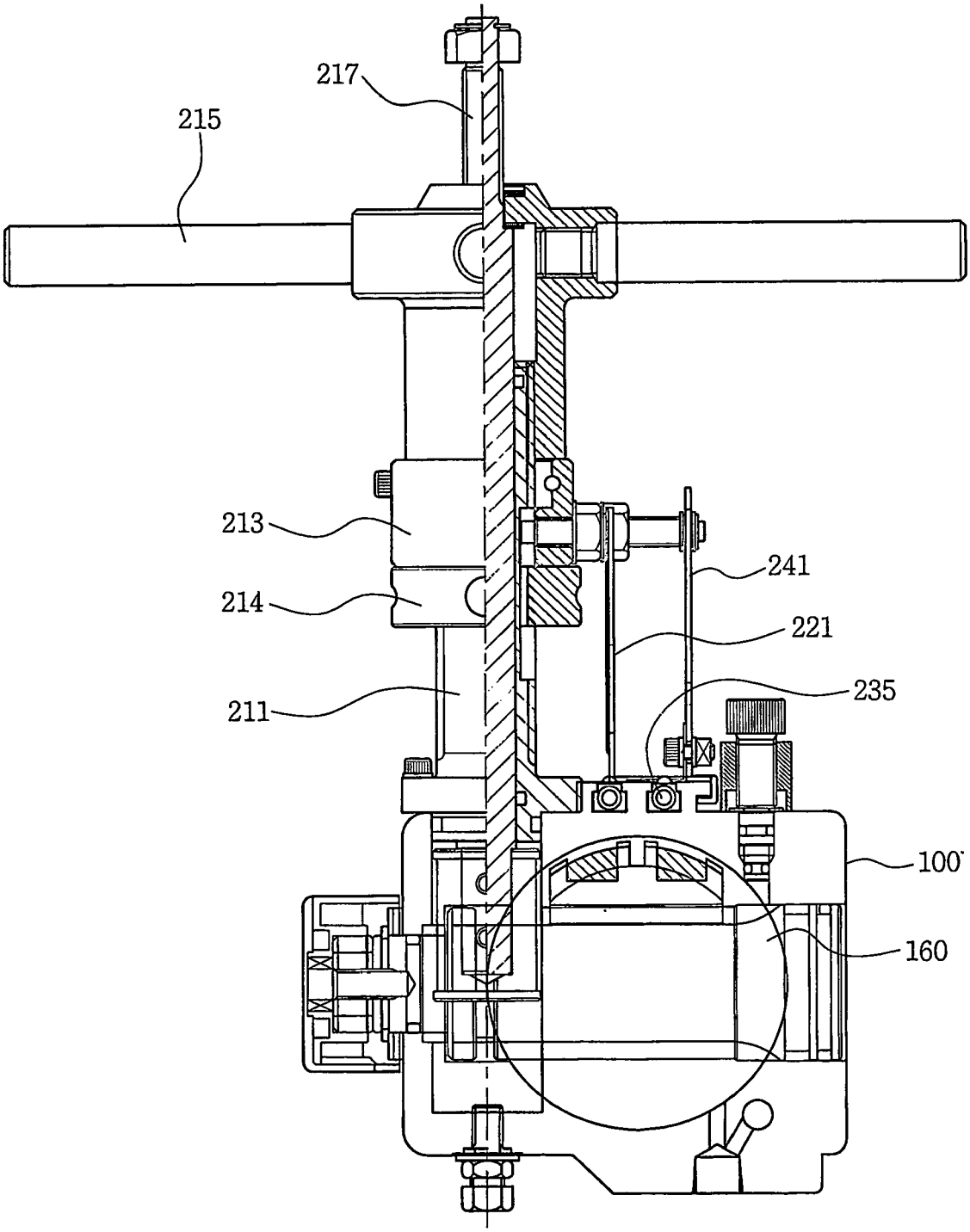
FIG. 5 is a section of FIG. 4

FIGS. 4 and 5 shows another embodiment of the invention. This embodiment is same as the above embodiment except that the slider 213 is moving vertically to the reciprocating direction of piston 160. That is, the guide 211 is installed on one side of the cylinder 100 vertically to the reciprocating direction of the piston 160, and the slider 213 mounted on the guide 211 is also moving vertically. A sliding plate 241 is installed on the surface of the cylinder 100 movably along the reciprocating direction of piston 160, and an inclined slot 243 is formed on the slide plate 241. A pin mounted on the slider 213 is engaged with the slot 243 so that as the slider 213 moves vertically to the reciprocating direction of the piston 160, the slide plate 241 will be moved along the reciprocating direction of the piston 160.

And a magnetic sensor 235 is installed on the sliding plate 241 adjacent to the cylinder 100, and a scale 221 is installed on the cylinder 100 near the sliding plate 241 and the needle 219 is attached on the sliding plate 241. And a slide hole 211*a* is formed in the longitudinal direction of the guide 211, and a reciprocating rod 217 is inserted in the slide hole 211*a*. The user may manipulate this rod 217 to move the piston 160 and the rotating axis 140. This embodiment may be advantageous in saving the occupying space depending on the field condition because the length of the apparatus may be shortened.

Figure 6:
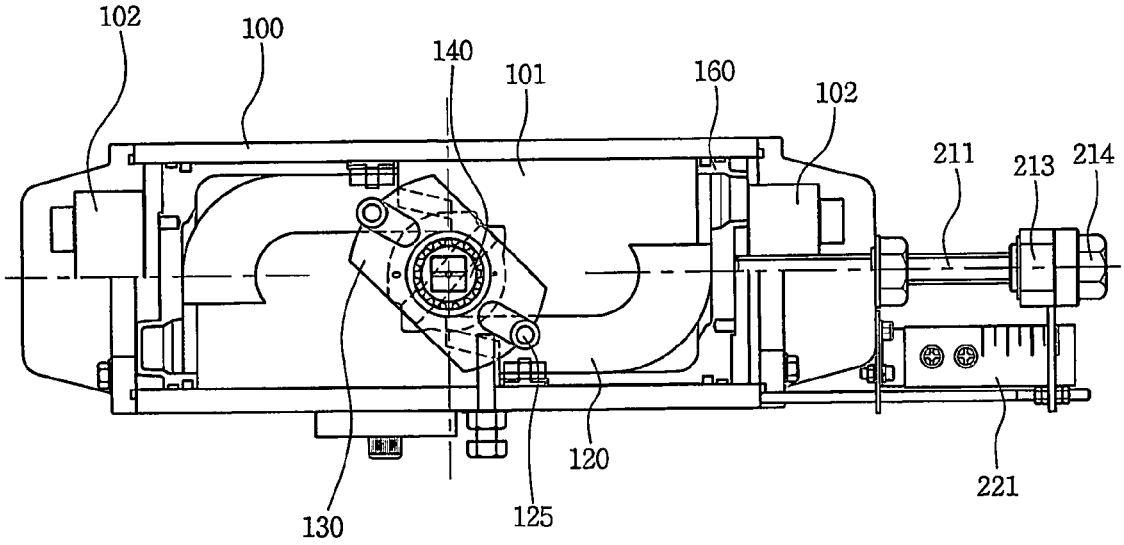
FIG. 6 is another embodiment of the invention

In the above preferred embodiment, the racks 120 and the pinion 130 is described as a power transmission unit, but other ordinary mechanism may be employed to convert the reciprocating force to rotating force. Such example is depicted in FIG. 6, in which a rotary member 130 is coupled to the rotating axis 130, and the links 120 are connected between the piston 160 and the rotary member 130.

And in the above embodiment, it is described that the cylinder 100 has two pistons 160 and the inner space is divided into two spaces. But, it is only exemplary and various formations will be possible about the shape and type of the cylinder 100.

INDUSTRIAL APPLICABILITY

According to the invention as described above, if the piston 160 is moved so much as the set displacement by sliding the slider 213, the magnetic sensor 235 will detect and send a signal to the solenoid valve 20 then the solenoid valve 20 will shut off the working flow, therefore the action range of the external unit coupled to the rotating axis 140 may be effectively adjusted without any complicated and high cost controller devices.

The invention claimed is:

1. An actuator having the function of control of operation displacement, which comprises of a cylinder in which a working flow is supplied, one or more piston reciprocally movable in the cylinder to divide the inner space of cylinder into the first space and the second space, a shaft rotatably mounted through the wall of the cylinder, a power transmission unit connected between the piston and the shaft to transfer the reciprocating force of piston to the shaft and the flow pathways connecting the first and the second space to the exterior solenoid valve, and the shaft could be rotated according to the action of solenoid valve, characterized in that the actuator further comprises of a magnet provided on one side of the piston, a guide 211 provided on one side of the cylinder perpendicularly to reciprocal direction of the piston, a slider being guided by the guide and moving perpendicularly to the reciprocal direction of the piston, a sliding plate provided outside of the cylinder and being movable along the reciprocating piston and having an inclined slot by which the slider is engaged, a magnetic sensor provided on one side of the sliding plate and being adjacent to the wall of the cylinder, the magnetic sensor being capable of sending a signal to the solenoid valve if the magnet is sensed, and an action range setting means having the scale representing displacement of the magnetic sensor, and the sliding plate is slid along the reciprocal direction of the piston as the slider moves.

2. An actuator of claim 1 wherein a slide hole is formed in the longitudinal direction on the center of the guide, and a reciprocating rod is inserted on the slide hole to move the piston reciprocally.

* * * * *